United States Patent [19]

Howard

[11] 4,036,198

[45] July 19, 1977

[54] IGNITION SYSTEM WITH PROGRAMMABLE DWELL

[76] Inventor: Homer E. Howard, 2024 Paloma Drive, Costa Mesa, Calif. 92627

[21] Appl. No.: 623,486

[22] Filed: Oct. 17, 1975

[51] Int. Cl.[2] ..... F02P 1/00

[52] U.S. Cl. ..... 123/146.5 A; 123/148 E

[58] Field of Search ..... 123/148 E, 148 DC, 148 AC, 123/148 CC, 146.5 A, 117 R

[56] References Cited

U.S. PATENT DOCUMENTS

| | | | |
|---|---|---|---|
| 3,087,090 | 4/1963 | Konopa | 123/148 E |
| 3,363,615 | 1/1968 | Meyerlo | 123/148 E |
| 3,408,993 | 11/1968 | Chavis | 123/148 E |
| 3,854,466 | 12/1974 | Steinberg et al. | 123/148 E |

*Primary Examiner*—Carroll B. Dority, Jr.
*Assistant Examiner*—Paul Devinsky
*Attorney, Agent, or Firm*—Gordon L. Peterson

[57] ABSTRACT

An engine ignition system connectible to a source of electrical energy and including an ignition coil and a timing device for repetitively and alternately providing first and second timing signals with the interval between adjacent timing signals being related to engine speed. The ignition system is responsive to the first timing signal for providing a triggering signal a variable interval after the first timing signal with the variable interval reducing with increases in engine speed. The ignition system includes a switching device which is responsive to the triggering signal and the second timing signal for completing a circuit from the source of electrical energy through the coil to charge the coil. The switching device is responsive to the second of the first timing signals to open the circuit to discontinue the charging of the coil.

9 Claims, 4 Drawing Figures

IGNITION SYSTEM WITH PROGRAMMABLE DWELL

BACKGROUND OF THE INVENTION

The energy of the spark resulting from the collapse of the magnetic field of an automotive ignition coil is a function of one half $LI^2$ where L is the inductance of the primary winding of the coil and I is the current. As the inductance for a given primary winding is a fixed value, then the energy which can be stored in the coil is directly proportional to the square of the current.

In the conventional automotive ignition system the flow of current into the ignition coil is controlled by mechanically actuated breaker points. It is very important in this type of system that the points be adjusted for proper dwell. Dwell is the number of degreees of crankshaft rotation during which the points are closed and current is allowed to flow into the coil. In the conventional ignition system, dwell will vary depending upon the number of cylinders in the engine. However, in the conventional automotive system, the dwell ratio is commonly set at two to one. Dwell ratio is the ratio of the time that the current flows into the ignition coil to the time that current does not flow into the ignition coil. In other words the dwell ratio is the ratio of the charging interval to the noncharging interval. For the typical breaker point system, the dwell ratio is the ratio of the period of time that the points are closed to the period they are open.

Because the energy of the ignition spark increases with increased current flow to the coil, many attempts have been made to increase the dwell ratio. One of these prior art devices includes two sets of points arranged so as to increase the dwell ratio. Other prior art systems use electronic means to increase the dwell ratio. The electronic systems typically employ a resistance-capacitor time constant circuit to activate a solid state switch device which, after a fixed predetermined period of time, initiates the flow of current into the coil. With this electronic system, current flow into the coil is initiated long before the breaker points close. This system does increase the dwell ratio at lower engine speeds. Unfortunately, however, the fixed predetermined period of time does not maintain this advantageous dwell ratio as engine speeds increase. Rather, the dwell ratio is reduced at higher engine speeds. In fact, at higher engine speeds the dwell ratio may be reduced to approximately the two to one ratio of the conventional automotive ignition system. Thus, at higher engine speeds where a high dwell ratio is needed most, the dwell ratio is low.

SUMMARY OF THE INVENTION

The present invention provides increased dwell throughout the range of normal engine speeds. With the present invention, the dwell ratio can, if desired, be held substantially constant throughout the range of normal engine operating speeds.

The present invention is adapted for use with an engine ignition system of the type which includes an ignition coil and timing means for repetitively and alternately providing first and second timing signals with the interval between adjacent timing signals being related to engine speeds. The timing means can be any device capable of providing these timing signals. For example, the timing means may be in the form of conventional breaker points or a breakerless distributor of the type shown, for example, in my U.S. Pat. No. 3,861,370.

One feature of the invention is the provision of means responsive to the first timing signal for providing a triggering signal a variable interval after the first timing signal with the variable interval reducing with increases in engine speed. In other words, the triggering signal occurs more rapidly after the occurrence of the first timing signal as engine speed increases. As explained more fully hereinbelow, this variable interval enables the dwell ratio to stay relatively high as engine speed increases.

Switch means is responsive to the triggering signal for completing a circuit from a source of electrical energy through the coil to charge the coil. The switch is also responsive to the next to occur of the first timing signals to open the circuit to discontinue the charging of the coil. Thus, the coil can be charged during a charging interval which extends from about the time of the initiation of the triggering signal to about the time of the second of the first timing signals. Coversely, the coil is not being charged during the variable interval of time, and accordingly the variable interval of time constitutes the noncharging interval.

The switch preferably responds sequentially to the triggering signal and the second timing signal to bring about charging of the coil. Specifically, the switch responds to the triggering signal to bring about charging of the coil until the occurrence of the second timing signal. Thereafter, the switch responds to the second timing signal to continue the current flow into, and the charging of, the coil.

To accomplish this, the switch can advantageously include a main switch, such as a transistor, and an electronic switch such as a silicon controlled rectifier (SCR). Means is provided which is responsive to the first timing signal for providing a switch control signal which increases in magnitude during a first interval which extends from about the time of the occurrence of the first timing signal at least until a triggering magnitude is reached. When the control signal reaches the triggering magnitude, it constitutes the triggering signal. The electronic switch is responsive to the control signal being of the triggering magnitude for providing a second triggering signal with the duration of the triggering signal being approximately coextensive with the period that the control signal is of at least the triggering magnitude.

To provide for the desired dwell ratio at higher engine speeds, the magnitude of the switch control signal is reduced gradually below the triggering magnitude in response to the second timing signal. As the switch control signal decays gradually, the amount of voltage rise in the control signal to achieve the triggering magnitude reduces as engine speed increases. In this manner, the noncharging interval is reduced as engine speed increases.

To provide for the desired control of the electronic switch, the control system includes an electrical energy storage device such as a capacitor coupled to a control terminal of the electronic switch. A charging circuit is coupled to the capacitor for charging the latter during the noncharging interval of the coil until the charge on the capacitor reaches at least the triggering magnitude. A discharging circuit is responsive to the second timing signal for gradually discharging the capacitor. The gradual discharge of the capacitor provides for the gradual decay of the magnitude of the switch control signal which is applied to the control terminal of the electronic switch.

In one specific circuit configuration, the charging circuit includes a charging resistor and the discharging circuit includes a discharging resistor. The two resistors and the capacitor are coupled together at a junction intermediate the two resistors. The charging resistor is adapted to be coupled to the source of electrical energy such as the automobile battery and the discharging resistor is coupled to a reference potential which may be ground.

Unlike the usual RC circuit, with the present invention the resistance of the charging resistor is larger than the resistance of the discharging resistor and preferably the charging resistor is several times as large as the discharging resistor. The rate of the decay of the switch control signal can be reduced by increasing the value of the discharging resistor.

Also unlike the usual RC circuit, the capacitor is preferably relatively large with a value of at least one microfarad being preferred. The rate of decay of the switch control signal decreases with an increase in the size of the capacitor.

The invention, together with further features and advantages thereof, can best be understood by reference to the following description taken in connection with the accompanying illustrative drawings.

DESCRIPTION OF THE PREFERRED EMBODIMENT

Figure 1:
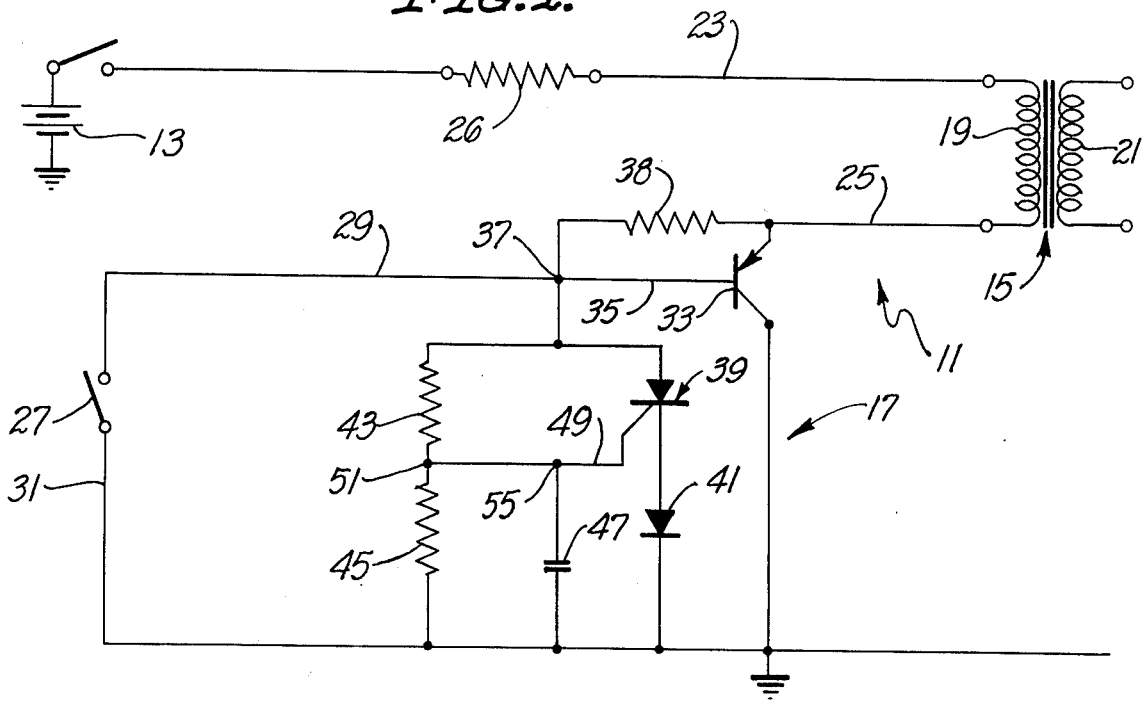
FIG. 1 is an electronic schematic of a simple engine ignition system constructed in accordance with the teachings of this invention.

FIG. 1 shows an engine ignition system 11 which includes a source of electrical energy in the form of a batttery 13, a coil 15, and a control system 17. The battery 13 may be the usual automobile battery.

The coil 15 may be of the type conventionally found in automobile ignition systems. The coil 15 includes a primary 19 and a secondary 21. The primary 19 is coupled by conductors 23 and 25 to the battery 13 and to the control system 17, respectively. The secondary 21 is coupled to a distributor (not shown) in the usual manner. A ballast resistor 26 may be provided, for example, between the primary 19 and the battery 13.

The ignition system 11 also includes means for providing timing signals as a function of engine speed. In the embodiment illustrated, such means includes a switch in the form of breaker points 27. The breaker points 27 are shown merely by way of example and any device which provides timing signals as a function of engine speed can be utilized. One side of the breaker points 27 is coupled to the primary 19 by the conductor 25 and a conductor 29. The other side of the breaker points 27 is coupled to a reference potential by a conductor 31. In the embodiment illustrated, the reference potential is ground.

As is well known, the breaker points 27 have two states, i.e. open and closed. The breaker points 27 are driven by the engine (not shown) with which the ignition system 11 is being used, and thus the breaker points 27 open and close at a rate controlled by the engine rpm.

The control system 17 includes a main switch in the form of a transistor 33 having its base coupled by a conductor 35 to the conductor 29 at a junction 37, its emitter coupled to the conductor 25, and its collector coupled to ground. In the embodiment illustrated, the transistor 33 is of the PNP type; however, obviously transistors of other types can be used. A resistor 38 is coupled between the emitter of the transistor 33 and the junction 37.

The control system 17 also includes an electronic switch which, in the embodiment illustrated, is an SCR 39. The anode of the SCR 39 is coupled to the junction 37 and the cathode of the SCR is coupled to the anode of the diode 41. The cathode of the diode 41 is coupled to ground.

A charging resistor 43 and a discharging resistor 45 are coupled between the junction 37 and ground. An electrical energy storage device such as a capacitor 47 is coupled between a conductor 49 and ground. The conductor 49 is coupled to the gate of the SCR 39 and to a junction 51 between the charging resistor 43 and the discharging resistor 45.

Figure 2:
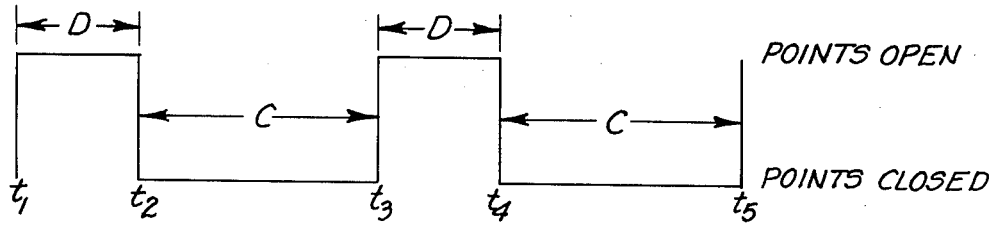
FIG. 2 is a plot of timing signals versus time.
Figure 3:
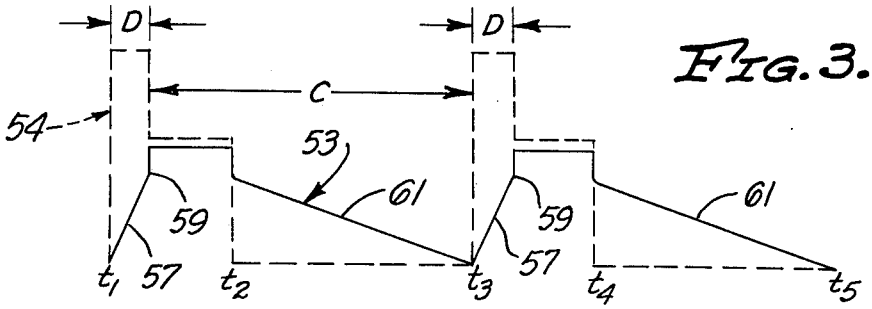
FIG. 3 is a plot of gate voltage and anode voltage versus time.
Figure 4:
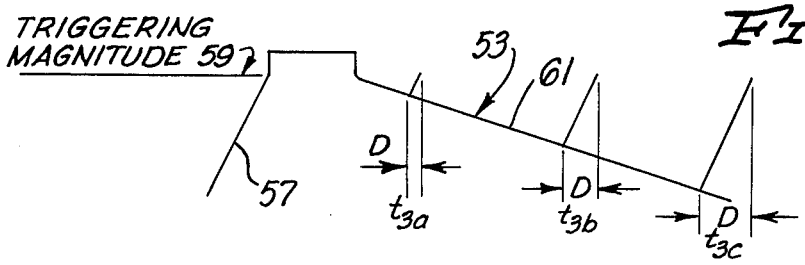
FIG. 4 is a plot of gate voltage versus time showing how the noncharging interval of the coil reduces with an increase in engine speed.

The operation of the ignition system 11 can best be understood by reference to FIGS. 2–4. FIG. 2 is a plot showing the state of the breaker points 27 with respect to time. Specifically, the breaker points 27 open at time $t_1$ and remain open until the time $t_2$ when they close. The breaker points 27 then remain closed until the time $t_3$ when they open again. This cycle is repeated with the points closing at the time $t_4$ and opening at the time $t_5$.

Each opening of the breaker points 27 provides a first timing signal and each closure of the breaker points provides a second timing signal. Because the breaker points 27 are driven by the engine for which the system 11 serves as the ignition system, the rate at which the timing signals is provided is directly proportional to engine speed.

In a conventional ignition system which does not have the control system 17, the primary 19 of the coil 15 charges when the points 27 are closed, and acccordingly the interval C from $t_2$ to $t_3$ is a charging interval. The interval D from $t_1$ to $t_2$ is a noncharging interval, i.e. a period during which the primary 19 is not being charged. For a conventional automotive ignition system, the dwell ratio, i.e. C:D is 2:1. In other words, for a conventional automotive ignition system, the breaker points 27 are closed during each cycle of operation for twice as long as they open. For the conventional system, the 2:1 dwell ratio is constant for all engine speeds.

The control system 17 substantially increases the dwell ratio and maintains the increased dwell ratio over the normal range of engine speeds. FIG. 3 shows a switch control signal 53 and an anode voltage signal 54 with respect to time, with the times $t_1$–$t_5$ corresponding to the times $t_1$–$t_5$ in FIG. 2. In the embodiment shown in FIG. 1, the switch control signal 53 is the voltage signal applied to the gate of the SCR 39. The switch control signal 53 may be considered as the voltage at a junction 55 between the capacitor 47 and the gate of the SCR 39.

At the time $t_1$, the points open to raise the voltage at the anode of the SCR 39 to approximately the voltage of the battery 13 and to permit charging of the capacitor 47 through the charging resistor 43. The conductive path from the junction 37 through the charging resistor 43 to the capacitor 47 constitutes a charging circuit for the capacitor. As the capacitor 47 is charged, the magnitude of the switch control signal 53 increases generally linearly as shown by a line segment 57 until it reaches a triggering magnitude 59. The capacitor 57 charges sufficiently rapidly so that the triggering magnitude 59 is reached prior to the time $t_2$ for all engine operating speeds. As explained morefully below the noncharging interval D is also the period required for charging the capacitor 47.

When the switch control signal 53 reaches the triggering magnitude 59, the switch control signal constitutes a triggering signal which causes the SCR 39 to conduct. When the SCR 39 is rendered conductive, the anode voltage signal 54 drops to a relatively low value which is determined, in part, by its own impedance and the impedance of the diode 41. When the SCR 39 is rendered conductive, the voltage at the gate, and hence the switch control signal 53, assumes the anode voltage level minus an internal drop of a small magnitude, such as .05 volt, and accordingly the switch control signal rises slightly above the triggering magnitude 59.

When the SCR 39 conducts, the magnitude of the voltage at the junction 37 drops, and this constitutes a triggering signal which turns on the transistor 33. Consequently, there is a conductive path from the battery 13 through the primary 19 and the transistor 33 to ground. This causes the primary 19 of the coil 15 to begin charging. Thus, the charging interval begins when the switch control signal 53 reaches the triggering magnitude 59, and this occurs substantially prior to the time $t_2$.

Charging of the primary 19 continues in this fashion until $t_2$ when the breaker points 27 close. When the breaker points 27 close, the voltage at the junction 37 becomes substantially ground potential. Because the voltage level between the diode 41, and the SCR 39 is above ground potential, the voltage across the SCR 39 reverses to turn off the SCR. Thus, as shown in FIG. 3, the anode voltage drops to approximately zero at the time $t_2$. As the switch control signal 53 is no longer boosted by the anode voltage, the switch control signal is now a function of the charge on the capacitor 47. The capacitor 47 begins discharging at the time $t_2$ through the junction 55 and the discharging resistor 45 to ground. Because the capacitor 47 discharges gradually, the magnitude of the switch control signal 53 decays gradually as shown by a sloping line segment 61. In the form shown in FIG. 3, it is assumed that the engine is running at a very low speed in which event the switch control signal 61 decays to zero at approximately the time $t_3$.

The closing of the breaker points 27 at the time $t_2$ keeps the transistor 33 on from the time $t_2$ until time $t_3$. Accordingly, the charging interval C continues from the time the switch control signal 53 reaches the triggering magnitudde 59 until the time $t_3$.

At the time $t_3$, the breaker points 27 open and this turns off the transistor 33. As there is no available charging path for the primary 19, the charging interval ceases until the switch control signal 53 again reaches the triggering magnitude 59. From the time $t_3$ until the switch control signal 53 again reaches the triggering magnitude 59, the charge in the primary 19 collapses to provide energy for a spark for the engine. The cycle described above is repeated rapidly so long as the engine is running.

As shown in FIG. 3, the dwell ratio C:D is significantly greater than the dwell ratio obtainable with conventional ignition systems and may be of the order of, for example, nine to one.

FIG. 4 illustrates how the improved dwell ratio of this invention is maintained over the full range of normal engine speeds. As indicated above, the capacitor 47 begins charging whenever the breaker points 27 open. Furthermore, the interval between the opening and closing of the breaker points 27 reduces as engine speed increases. If the breaker points 27 were to open rapidly, as would occur at high engine speeds, at a point $t_{3a}$, then the switch control signal 53 would have to increase only a relatively small amount in order to reach the triggering magnitude 59. In other words, at the time $t_{3a}$, the capacitor 47 is still nearly fully charged and only a small additional charge is required in order for the switch control signal 53 to reach the triggering magnitude 59. As the time required to charge the capacitor 47 is a function of the amount of charge to be added, this relatively small additional charge can be added in a relatively short interval.

If the points open more slowly such as the times $t_{3b}$ or $t_{3c}$ in response to lower engine speeds, the switch control signal 53 has further decayed with the result that an increased interval D is necessary to increase the magnitude of the switch control signal 53 to the triggering magnitude 59. Thus, FIG. 4 shows that the noncharging interval D of the primary 19 varies inversely with engine speed. At high engine speeds, the noncharging interval D of the primary 19 is relatively small and at lower engine speeds, the noncharging interval D is relatively large. By reducing the noncharging interval D as engine speed increases, the ratio of C to D, i.e. the dwell ratio, can be maintained substantially constant over the normal engine operating speeds.

The slope of the line segment 61 can be varied as desired. For example, by increasing the size of the capacitor 47, the slope of the line segment 61 decreases, i.e. the rate of decay of the switch control signal 53 reduces. Similarly, by increasing the value of the discharging resistor 45, the slope of the line segment 61 can be reduced.

In order for the line segment 61 to have any worthwhile slope, the resistance of the discharging resistor 45 should be less than the resistance of the charging resistor 43. The resistance of the charging resistor 43 can be selected depending upon the rate at which it is desired to charge the capacitor 47. By way of example, the capacitor 47 may have a capacitance of one microfared, the discharging resistor may have a resistance of 5600 ohms, and the charging resistor 43 may have a resistance of 50,000 ohms.

Although an exemplary embodiment of the invention has been shown and described, many changes, modifications and substitutions may be made by those with ordinary skill in the art without necessarily departing from the spirit and scope of this invention.

I claim:

1. An engine ignition control system electrically connectible to an ignition circuit which includes a source of electrical energy, an ignition coil, and timing means for repetitively and alternately providing first and second timing signals with the interval between adjacent timing signals being related to engine speed, said control system comprising:

means responsive to one of the first timing signals for providing a triggering signal a variable interval after said one timing signal and before the next to occur of the second timing signals subsequent to said one timing signal with the variable interval reducing with increases in engine speed;

switch means responsive to said triggering signal for completing a first circuit from the source of electrical energy through the coil to charge the coil; and said switch means including means responsive to the next to occur of the first timing signals subsequent to said one timing signal to open said first circuit to discontinue the charging of the coil whereby the coil can be charged during charging interval which extends from about the time of the initiation of the triggering signal to about the time of said next to occur of the first timing signals and said coil is not being charged during said variable interval of time.

2. An engine ignition control system defined in claim 1 wherein said first-mentioned means varies said variable interval so that the ratio of said charging interval to said variable interval is substantially constant over a major range of engine speeds.

3. An engine ignition control system as defined in claim 1 wherein said switch means is responsive to the triggering signal to complete said first circuit from about the time of the initiation of the triggering signal to about the time of said next to occur of the second timing signals and is responsive to such second timing signal to complete said first circuit during the remainder of the charging interval.

4. An engine ignition control system as defined in claim 1 wherein the triggering signal is a first triggering signal and said switch means includes electronic switch means responsive to the first triggering signal for providing a second triggering signal and main switch means responsive to the second triggering signal and said next to occur of the first timing signals for completing said first circuit.

5. An engine ignition control system as defined in claim 1 wherein said first-mentioned means includes first and second impedances couplable to the coil, the timing means and to a reference potential and capacitor means for storing an electrical charge, said impedances and said capacitor means being coupled to a common junction with the first impedance being between said junction and the coil and the second impedance being between the junction and the reference potential, the value of said first impedance being greater than the value of said second impedance.

6. An engine ignition control system electrically connectible to an ignition circuit which includes a source of electrical energy, an ignition coil, and timing means for repetitively and alternately providing first and second timing signals with the interval between adjacent timing signals being related to engine speed, said control system comprising:

first means responsive to the first timing signal for providing a switch control signal which increases in magnitude during a first interval which extends from about the time of the occurrence of the first timing signal at least until a triggering magnitude is reached, said switch control signal having a first magnitude which is the minimum magnitude for said switch control signal;

electronic switch means responsive to the switch control signal being of said triggering magnitude for providing a triggering signal with the duration of said triggering signal being approximately coextensive with the period that said switch control signal is of at least said triggering magnitude;

said first means includng means responsive to the second timing signal for reducing the magnitude of the switch control signal below the triggering magnitude and gradually reducing the magnitude of the switch control signal toward said first magnitude whereby as engine speed increases the control signal need only increase in magnitude from some value above said first magnitude to said triggering magnitude to thereby reduce said first interval; and main switch means responsive to said triggering signal and said second timing signal for completing a first circuit from the source of electrical energy through the coil to charge the coil from about the time that said switch control signal reaches said triggering magnitude until about the time of the occurrence of the next of the first timing signals.

7. An engine ignition control system as defined in claim 6 wherein said first means includes first and second resistors coupled to the coil, the timing means and to a reference potential and capacitor means for storing an electrical charge, said resistors and said capacitor means being coupled to a common junction with the first resistor being between said junction and the coil and the second resistor being between the junction and the reference potential, the value of said first resistor being greater than the value of said second resistor.

8. An engine ignition control system as defined in claim 7 wherein said electronic switch means is coupled to the timing means, said control system includes at least one diode coupled between the electronic switch means and the reference potential.

9. An engine ignition control system as defined in claim 6 wherein said electronic switch means has a control terminal, said first means includes electrical energy storage means coupled to said control terminal, charging circuit means coupled to the electrical energy storage means for charging the latter during said first interval at least until the charge reaches said triggering magnitude and discharge circuit means responsive to the second timing signal for gradually dishcarging the electrical energy storage means.

* * * * *